US006606055B2

(12) United States Patent
Halsema et al.

(10) Patent No.: US 6,606,055 B2
(45) Date of Patent: Aug. 12, 2003

(54) PHASED ARRAY COMMUNICATION SYSTEM PROVIDING AIRBORNE CROSSLINK AND SATELLITE COMMUNICATION RECEIVE CAPABILITY

(75) Inventors: Paul B. Halsema, Palm Bay, FL (US); Henry S. Abercrombie, Satellite Beach, FL (US); Mark D. Vanstrum, Indialantic, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/002,638

(22) Filed: Dec. 5, 2001

(65) Prior Publication Data

US 2002/0118137 A1 Aug. 29, 2002

Related U.S. Application Data

(60) Provisional application No. 60/251,551, filed on Dec. 6, 2000.

(51) Int. Cl.[7] ..... H01Q 3/22; H01Q 3/24; H01Q 3/26

(52) U.S. Cl. ..... 342/368; 342/373

(58) Field of Search ..... 342/368, 372, 342/373, 374

(56) References Cited

U.S. PATENT DOCUMENTS

| | | | | |
|---|---|---|---|---|
| 3,747,102 A | | 7/1973 | Cooper | 343/106 |
| 5,726,666 A | | 3/1998 | Hoover et al. | 343/770 |
| 6,052,098 A | | 4/2000 | Killen et al. | 343/795 |
| 6,072,994 A | | 6/2000 | Phillips et al. | 455/84 |
| 6,075,484 A | * | 6/2000 | Daniel et al. | 342/372 |
| 6,201,510 B1 | | 3/2001 | Lopez et al. | 343/799 |
| 6,208,287 B1 | * | 3/2001 | Sikina et al. | 342/174 |
| 6,222,480 B1 | | 4/2001 | Kuntman et al. | 342/30 |
| 6,313,783 B1 | | 11/2001 | Kuntman et al. | 342/32 |
| 6,441,783 B1 | * | 8/2002 | Dean | 342/372 |

* cited by examiner

*Primary Examiner*—Dao Phan
(74) *Attorney, Agent, or Firm*—Allen, Dyer, Doppelt, Milbrath & Gilchrist, P.A.

(57) ABSTRACT

A phased array communication system and method has a plurality of phased array antenna structures disbursed throughout an aircraft in a manner to provide substantially spherical antenna coverage around the aircraft. The system includes n-element arrays and transmit/receive modules connected to respective elements forming the array. A beam forming network and antenna interface unit are included. Communication signals are converted between a satellite downlink frequency band and a communications band used by Communication, Navigation and Identification (CNI) components, known to those skilled in the art, for allowing (a) air-to-air crosslink communication; (b) satellite receive communications; and (c) air-to-ground data link communications at a satellite downlink frequency band. A communications transceiver is operatively connected to each antenna interface unit for receiving and transmitting communication signals within a communications band used by communication, navigation and identification (CNI) components to and from the phased array antenna structures.

26 Claims, 12 Drawing Sheets

PHASED ARRAY COMMUNICATION SYSTEM PROVIDING AIRBORNE CROSSLINK AND SATELLITE COMMUNICATION RECEIVE CAPABILITY

This application claims the benefit of Provisional Application No. 60/251,551 filed Dec. 6, 2000.

FIELD OF THE INVENTION

This invention relates to phased array communication systems, and more particularly, this invention relates to aircraft communications using phased array antenna structures.

BACKGROUND OF THE INVENTION

Tactical aircraft require different communication systems that are operable in different bands at various wavelengths and frequencies. For example, a tactical aircraft may have one antenna and communication system for receiving beyond line-of-site satellite communications in the Ka band, such as communications at around 20 GHz. The aircraft also may use a second, separate antenna and communications system for medium to long range air-to-air crosslink communications with other aircraft, such as by using an upper and/or lower phased array antenna structure operable in the L band (e.g., around 1530–2700 MHz). The same L band communications equipment could possibly also be used for air-to-ground data link communications, or a separate, third antenna and communications system could be used for this air-to-ground data link. It is evident that the various communication and data link systems used by a tactical aircraft are arranged by using multiple, federated systems having one narrow band communication system for the air-to-air crosslink, a second narrow band communication system for the satellite communications, and perhaps even a third narrow band communications system for the air-to-ground data link. A drawback of such disparate communications systems on tactical aircraft is that these systems do not provide needed tactical weapon system data rates or operational range. They also require large and heavy antenna systems. The prior art focus on a single, communication function for each communications system increases the cost, adds complexity, and requires large and heavy antenna systems.

Further drawbacks are the numerous and different hardware components often used in these disparate prior art systems. Some of the larger systems have used cross slot antennae or blade antennae with narrow band/low data rate operation. Also, the use of single function hardware components for each air-to-air, air-to-ground or satellite communication system often requires a single, unique waveform for each system. Again, this is not advantageous because it adds complexity and requires additional hardware systems.

SUMMARY OF THE INVENTION

The present invention advantageously overcomes the drawbacks of the prior art communication systems using multiple and separate, narrow band systems. The present invention provides multiple and small phased array antenna structures deployed around an aircraft with a medium band to wideband, high data rate operation. The system of the present invention allows multiple, selectable functions for air-to-air crosslink communications, satellite receive communications, and air-to-ground data link communications. Waveforms can be selected for each communication function, and in one aspect of the invention, the communications occur at a satellite, downlink frequency band.

The system allows the use of a frequency spectrum and associated communication systems with the ability to connect to tactical aircraft, communication satellites, and ground users using a single hardware implementation. Phased array antenna structures are deployed around the aircraft for spherical coverage to ensure efficient communications with low probability of intercept (LPI) and use of standard Communications, Navigation and Identification (CNI) systems typically operable in the L band.

In accordance with one aspect of the present invention, a phased array communication system for an aircraft includes a plurality of phased array antenna structures disbursed around an aircraft in a manner to provide substantially spherical antenna coverage around the aircraft. Each phased array antenna structure has an n-element array and transmit/receive modules operatively connected to respective elements forming the n-element array. A beam forming network is operatively connected to the transmit/receive modules. An antenna interface unit is operatively connected to the beam forming network and converts communication signals between a satellite downlink frequency band and a communications band used by Communication, Navigation and Identification (CNI) components known to those skilled in the art for allowing (a) air-to-air crosslink communication; (b) satellite receive communications; and (c) air-to-ground data link communications at a satellite downlink frequency band. A communications transceiver is operatively connected to each antenna interface unit and receives and transmits communication signals within a communications band used by Communication, Navigation and Identification (CNI) components to and from the phased array antenna structures.

In another aspect of the present invention, the phased array communications system includes six phased array antenna structures, each providing +/− about 48 to about 59 degrees scan. In another aspect of the present invention, three phased array antenna structures each provide +/− about 65 to about 75 degrees scan.

Each phased array antenna structure further includes a controller operatively connected to each transmit/receive module for controlling the beam of a phased array antenna. The controller is operative for selecting between communication waveforms and protocol functions for air-to-air crosslink, satellite receive and air-to-ground data link communications. A communications waveform and protocol function is selected based on the need of a supported aircraft weapon system in yet another aspect of the present invention.

Each phased array antenna structure includes a power converter for converting power from an on-board power source into power suitable for operation of the phased array antenna structure. Each phased array antenna structure can be operable within the Ka band for receiving satellite communication signals. The antenna interface unit is operable for converting S band communication signals into a satellite downlink frequency band, in yet another aspect of the present invention. The satellite communication systems often work in the Ka band, a typical satellite downlink frequency band, and the one system of the present invention is operable in the satellite downlink frequency band.

In yet another aspect of the present invention, each phased array antenna structure can be about three inches diameter, having about 45 to about 55 antenna elements. Each transmit/receive module can further comprise respective transmit and receive phase shifters and amplifiers.

A method of communication to and from an aircraft is also disclosed and comprises the step of selecting communications waveform and protocol for one of (a) air-to-air crosslink communication; (b) satellite receive communications; and (c) air-to-ground data link communications at a satellite downlink frequency band using a plurality of phased array antenna structures disbursed around an aircraft in a manner to provide substantially spherical antenna coverage around the aircraft. Each phased array antenna structure has an n-element array, n transmit/receive modules operative connected to respective elements forming said n-element array, and a beam forming network operatively connected to the transmit/receive module. An antenna interface unit is operatively connected to the beam forming network for converting communication signals between a satellite downlink frequency band and a communications band used by Communication, Navigation and Identification (CNI) components. Communication signals can be received and transmitted within the communications band used by Communication, Navigation and Identification (CNI) components to and from the phased array antenna structures via a communications transceiver operatively connected to each antenna interface unit of each phased array antenna structure.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
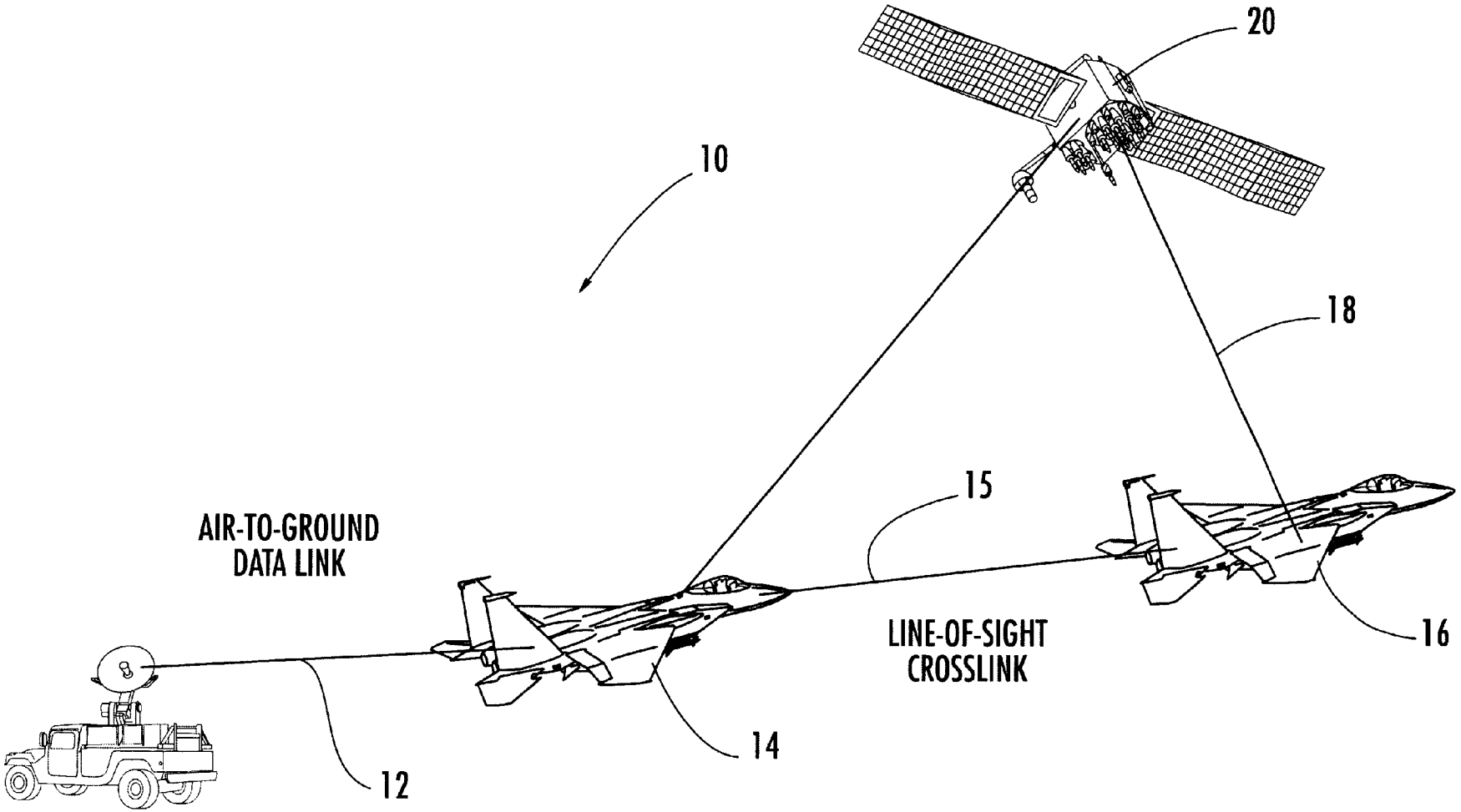
FIG. 1 shows the various communications of an aircraft using the phased array communication system of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The present invention advantageously provides a phased array communication system for an aircraft operative in a satellite downlink frequency band and using contiguous crosslink frequency communications. Multiple phased array antenna structures are disbursed around an aircraft in a manner to provide substantially spherical antenna coverage around the aircraft. This spherical coverage and associated system allows medium to wideband and high data rate operation with multiple, selectable functions such as air-to-air crosslink communications, satellite receive communications, and air-to-ground data link communications at the satellite downlink frequency band.

Waveforms can be selected for each communication function by a controller that is operative with each phased array antenna structure. The small size, low weight and low cost of this multiple phased array antenna structure is available for high capacity data rate transfer and communications.

The present invention is advantageous over separate, multiple prior art systems using different communications, such as the air-to-air crosslink communications, satellite receive communications and air-to-ground data link communications. Some prior art designs had also used less conventional antenna designs, including crossed slot or blade antennas having narrow band and low data rate operation and generating a single, unique waveform for each system. The present invention is also advantageous over various passive antenna arrays that have no amplifiers.

Many prior art passive arrays require significantly larger areas to maintain the gain/noise temperature of the antenna if a smaller beamwidth and larger area is an option. Transmitter passive arrays are not advantageous because they require significantly higher DC power to maintain the equivalent isotropic radiated power (EIRP). Also, passive arrays sometimes use complicated waveguide and microstrip elements and feeds with ferrite phase shifters (and possibly MMIC phase shifters) and some micromachine electromechanical (MEMS) switch technology. These types of components are complicated and add to the overall cost of prior art systems. The present invention has a secure, low probability of intercept airborne crosslink with spherical coverage, and a secure, wide bandwidth airborne satellite communication receive capability that facilitates SOS and BLOS operations. The common antenna structure with an antenna interface unit provides minimal impact on the air frame.

FIG. 1 illustrates the basic types of communication possible with the phased array communication system 10 of the present invention and shows the air-to-ground data link 12 and an aircraft 14, a line-of-sight, air-to-air crosslink communication link 15 between the aircraft 14 and another aircraft 16, and the satellite receive communications link 18 from a military communication satellite 20 to the aircraft 14,16.

Figure 2A:
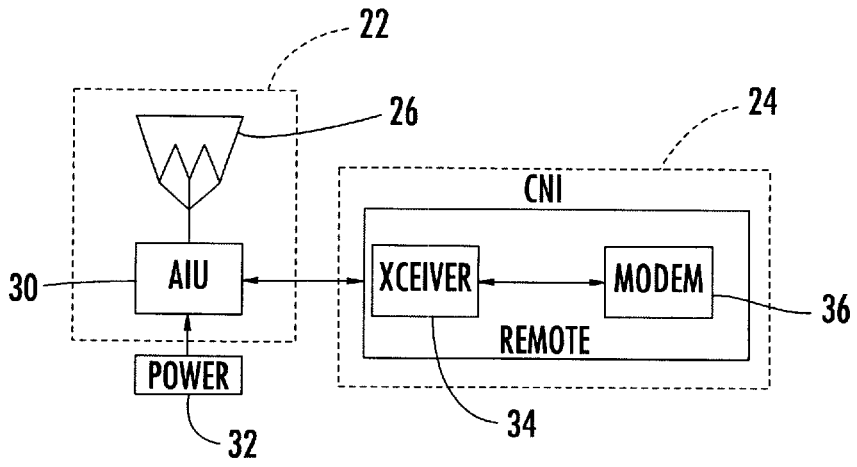
FIG. 2A is a high level block diagram showing the phased array antenna structure and remote communications equipment operatively connected to an antenna interface unit of the present invention.

FIG. 2A illustrates the basic high level functional components used with the present invention, showing a phased array antenna structure 22 and remote equipment 24 as part of the Communication, Navigation and Identification (CNI) components and systems known to those skilled in the art. The phased array antenna structure 22 includes the basic n-element array 26 and antenna interface unit (AIU) 30 receiving power from an on-board aircraft power source 32. The communication, navigation and identification (CNI) components, known to those skilled in the art, include the remote equipment 24 including a transceiver 34 and, in some cases, a modem 36, which is operable with the antenna interface unit 30. In one aspect of the invention, the antenna interface unit 30 acts as an interface for converting communication signals between a satellite downlink frequency band and a communications band used by the Communication, Navigation and Identification (CNI) components. For example, the satellite downlink frequency band is often a Ka band of about 20 GHz, and the Communication, Navigation and Identification (CNI) components are operable at the L band of about 1530 to about 2700 MHz. Although these ranges are only non-limiting examples of the bands used with the present invention, they are often the more popular bands in use.

Figure 2B:
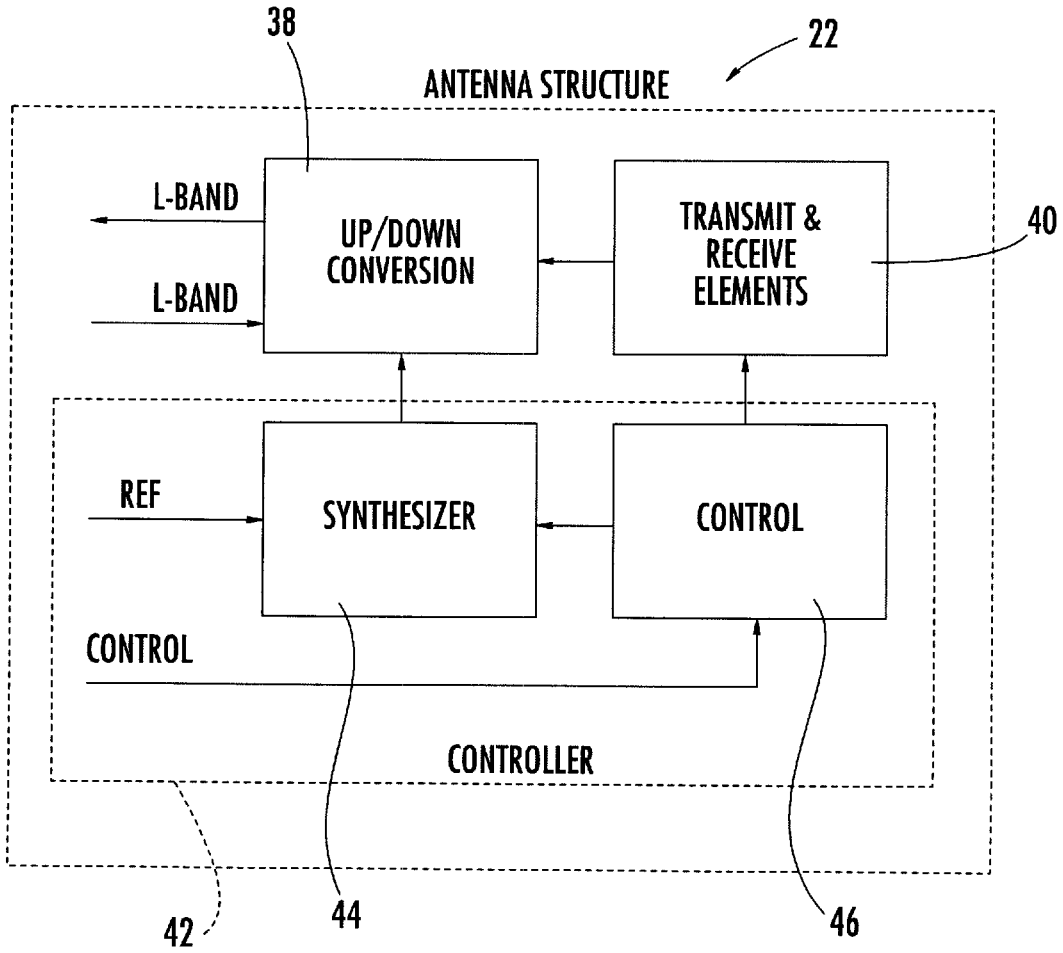
FIG. 2B is another high level block diagram showing basic functions of the phased array communication system of the present invention.

FIG. 2B illustrates a high level block diagram of various components and functions for the antenna structure 22 of the present invention, showing up/down conversion 38 using the antenna interface unit 30 and operable with transmit and receive circuit elements 40 of the antenna structure. A controller (shown by dashed lines at 42) is operative for generating synthesizer signals 44 and control signals 46 using reference and control standards known to those skilled in the art.

Figure 3:
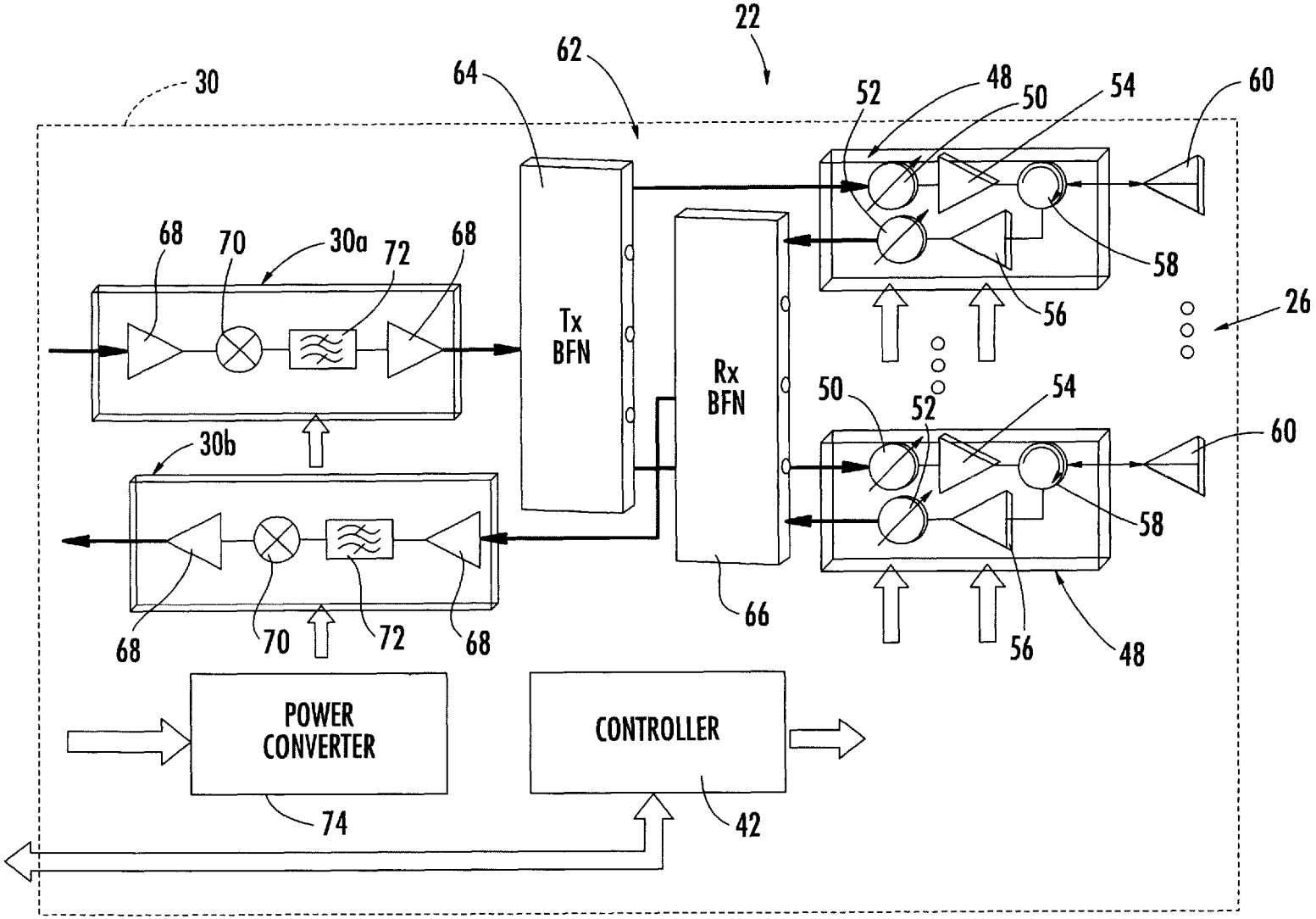
FIG. 3 is a more detailed block diagram showing basic components of an exemplary phased array antenna structure of the present invention.

FIG. 3 illustrates a more detailed block diagram of the phased array antenna structure 22 of the present invention and illustrates the n-element array 26 and an associated transmit/receive module 48 having respective transmit and receive phase shifters 50,52 and amplifiers 54,56 that are selectively operable by actuating a signal circulator 58. Each transmit/receive module 48 is operable with a respective array element 60 forming part of the n-element array 26. A beam forming network 62 includes a transmit beam forming network 64 and receive beam forming network 66 operatively connected to the respective transmit and receive phase shifters 50, 52 of transmit/receive modules 48. An antenna interface unit 30 is operatively connected to the beam forming network 64 and converts the communication signals between a satellite downlink frequency band and communications band used by Communication, Navigation and Identification (CNI) components of the remote equipment 24 for allowing the air-to-air crosslink communications 15, satellite receive communications 18 and air-to-ground data link communications 12 at a satellite downlink frequency band.

The antenna interface unit 30 includes transmit and receive circuits 30*a*, 30*b* with appropriate amplifiers 68, mixers 70 and bandpass filters 72 as illustrated. The controller 42 is operatively connected to each transmit/receive module 48 for controlling the beam of the phased array antenna structure and selecting between desired communications waveforms and protocol functions for an air-to-air crosslink, satellite receive and air-to-ground data link communication. The communications waveform and protocol function can be selected based on the need of a supported aircraft weapon system, as known to those skilled in the art. A power converter 74 is also operable for converting power from the on-board power source 32 into power suitable for operation of the phased array antenna components, including the various components of the antenna interface unit and the transmit/receive modules.

Figure 4:
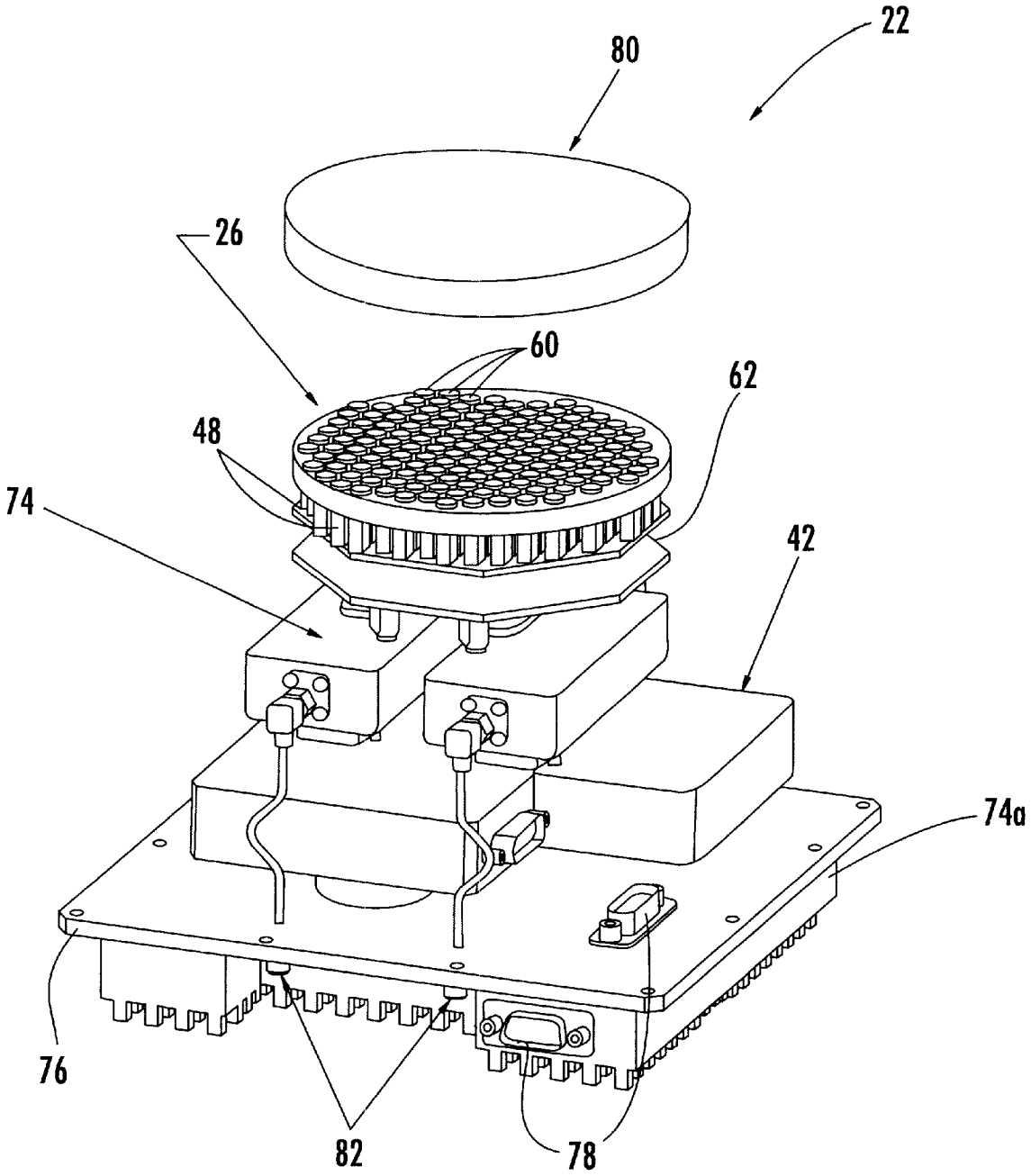
FIG. 4 is an isometric view of one possible structural implementation of the phased array antenna structure of the present invention.
Figure 5:
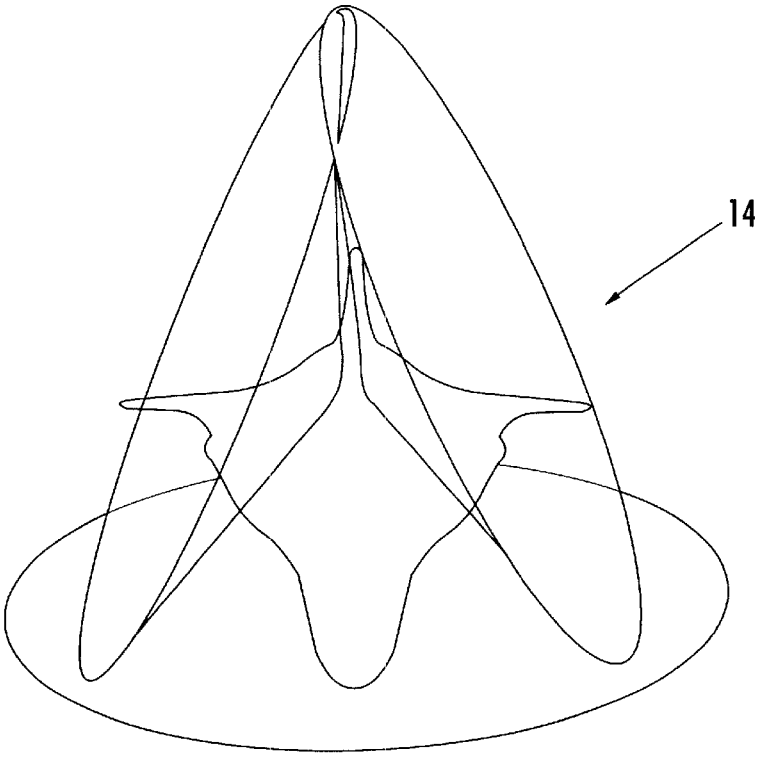
FIGS. 5 and 6 are respective front and rear views of an aircraft showing the location and field of view of three phased array antenna structures with +/−70 degree scan.
Figure 6:
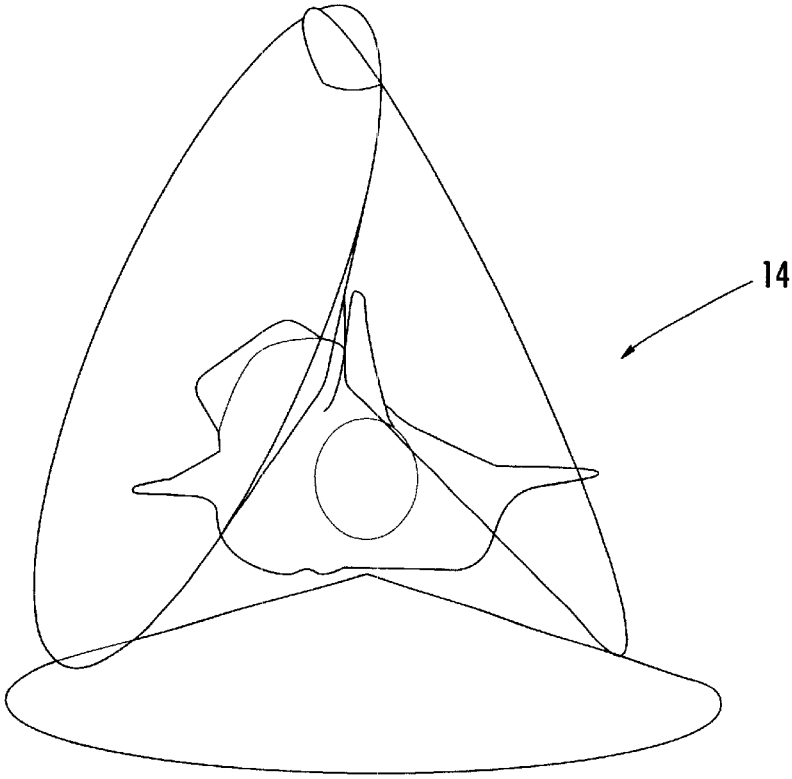

FIG. 4 illustrates one possible physical structure for a phased array antenna structure 22 of the present invention, using a mounting plate 76 for holding the power supply input/output module 74*a* as part of the power converter 74 and various input/output connectors 78 for coaxial cable or other connections known to those skilled in the art. The power converter 74 is operative with various components, including the controller 42 and beam forming network 62. The n-element array 26 is operative with a radome 80 and each array element 60 has a respective transmit/receive module 48 operative therewith. Radio Frequency (RF) input/output ports 82 are also provided. In one aspect of the present invention, each phased array antenna structure 22 is about three inches in diameter and has about 45 to about 55 antenna elements, and in one aspect of the invention has 48 elements.

The power converter 74 can be operative for interaction with 270 volt or 28 volt DC power from the aircraft. The antenna interface unit 30 is operative with the CNI components, central electronic units as part of remote equipment 24 on the aircraft, operable typically at L band frequencies. The type of modulation encoding used in the advantageous system of the present invention can vary, but one modulation is quadrature phase shift key modulation (QPSK) having a concatenated rate of one-half, K=7 for Viterbi inner code with (255, 238) Reed-Solomon outer code. This could provide a $10^{-6}$ bit error rate (BER) at 5.5 dB $E_b/N_o$, including 2.5 dB implementation loss.

Figure 7:
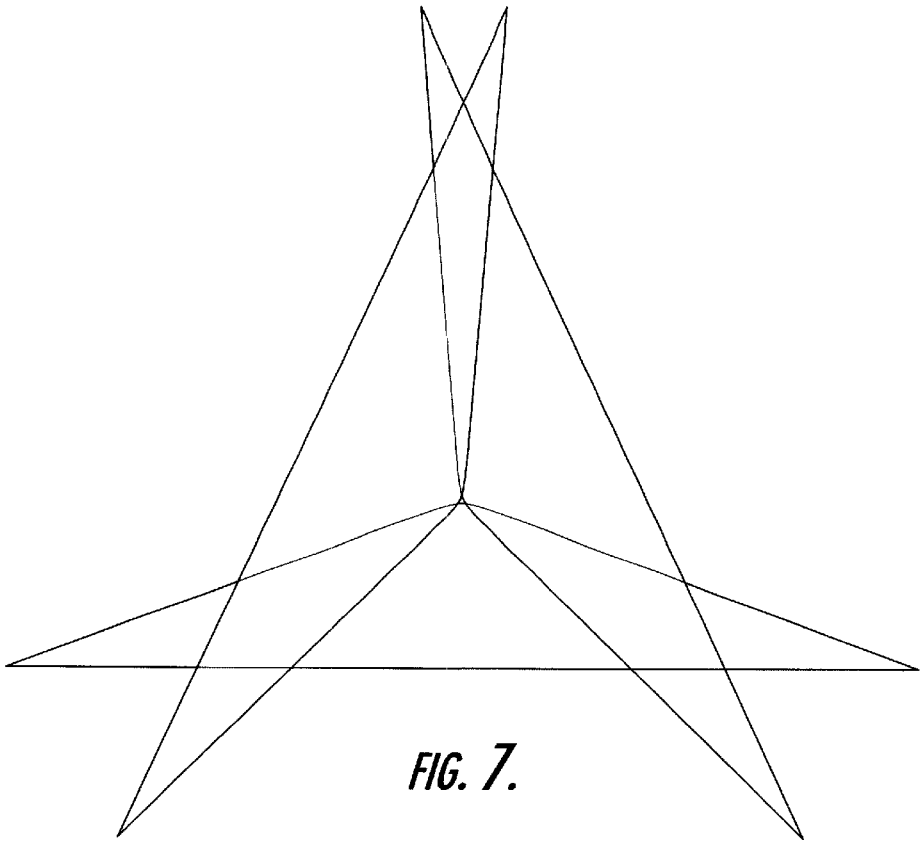
FIGS. 7 and 8 are respective front and rear views of the coverage of three phased array antenna structures on an aircraft with +/−70 degree field of view.
Figure 8:
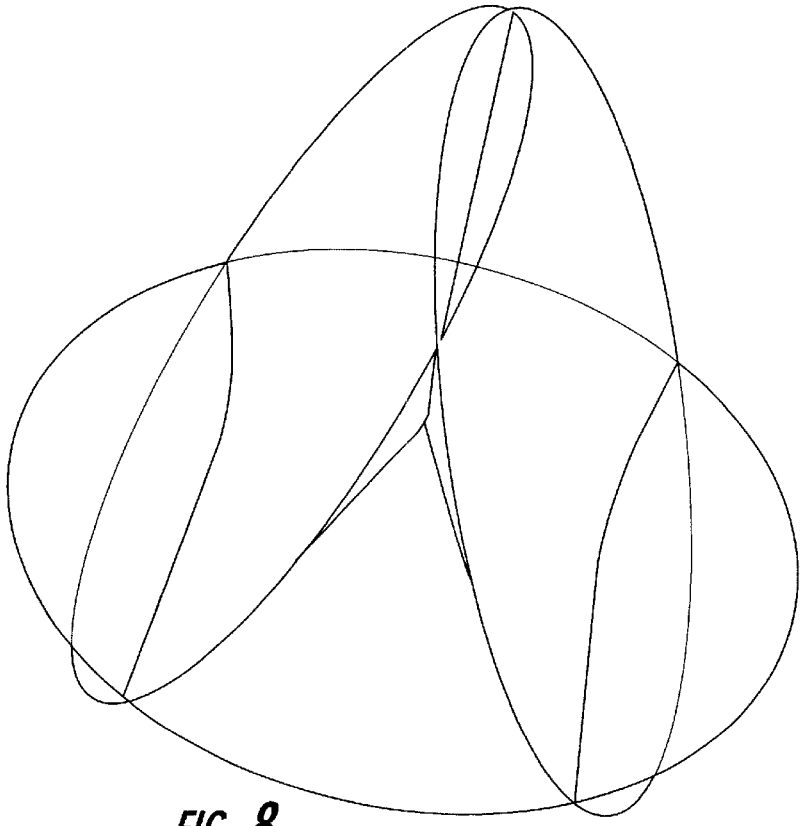

FIGS. 5–8 illustrate the location field of view using three phased array antenna structures with a +/−70 degree scan and +/−70 degree field of view (FIGS. 7 and 8). The array size can be determined by the half-power beam width. A 150 element, 70 degree scan design could have a 30 degree scanned HPBW. A 15 degree HPBW at a 70 degree scan could require 1,635 elements (3×545). The scan range can be traded for the total element count, resulting in eight arrays with 96 elements each, and a +/−43 degree scan per array. Controlling the scan beam coverage to no more than the coverage area of a 15 degree pencil beam requires six 70 element arrays scanned to +/−53 degrees. This would allow the coverage area to grow to the equivalent of a 20 degree pencil beam and lead to six 48 element arrays. In one example, a 48 element array could provide 90% link availability at 20,000 feet for the following data rates versus scan range:

| Scan | Data Rate |
|---|---|
| 30° | 700 kbps |
| 45° | 500 kbps |
| 53° | 400 kbps |

Figure 9:
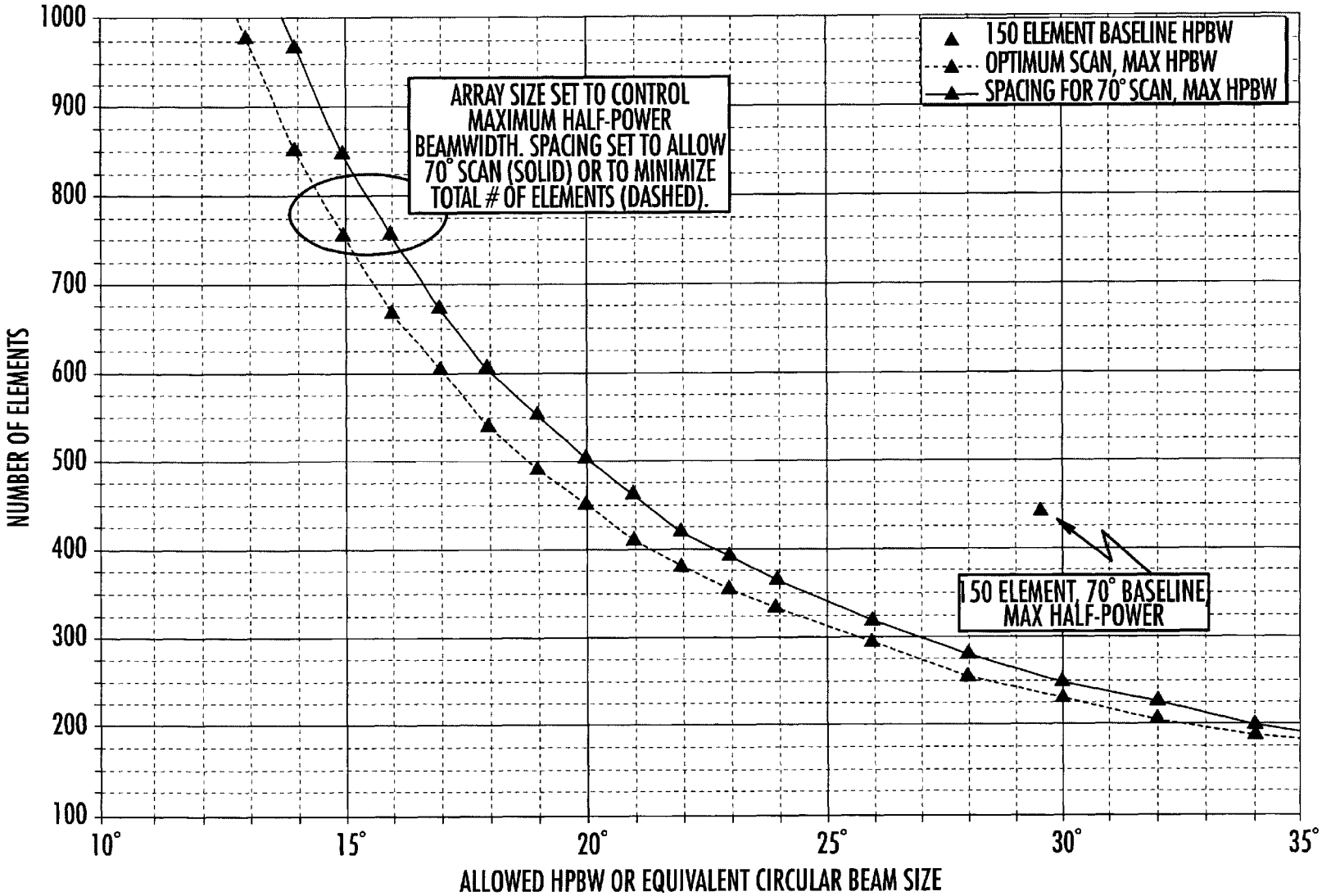
FIG. 9 is a graph illustrating the total element count required for spherical coverage with a constrained, scanned half-power beam width in accordance with one aspect of the present invention.
Figure 10:
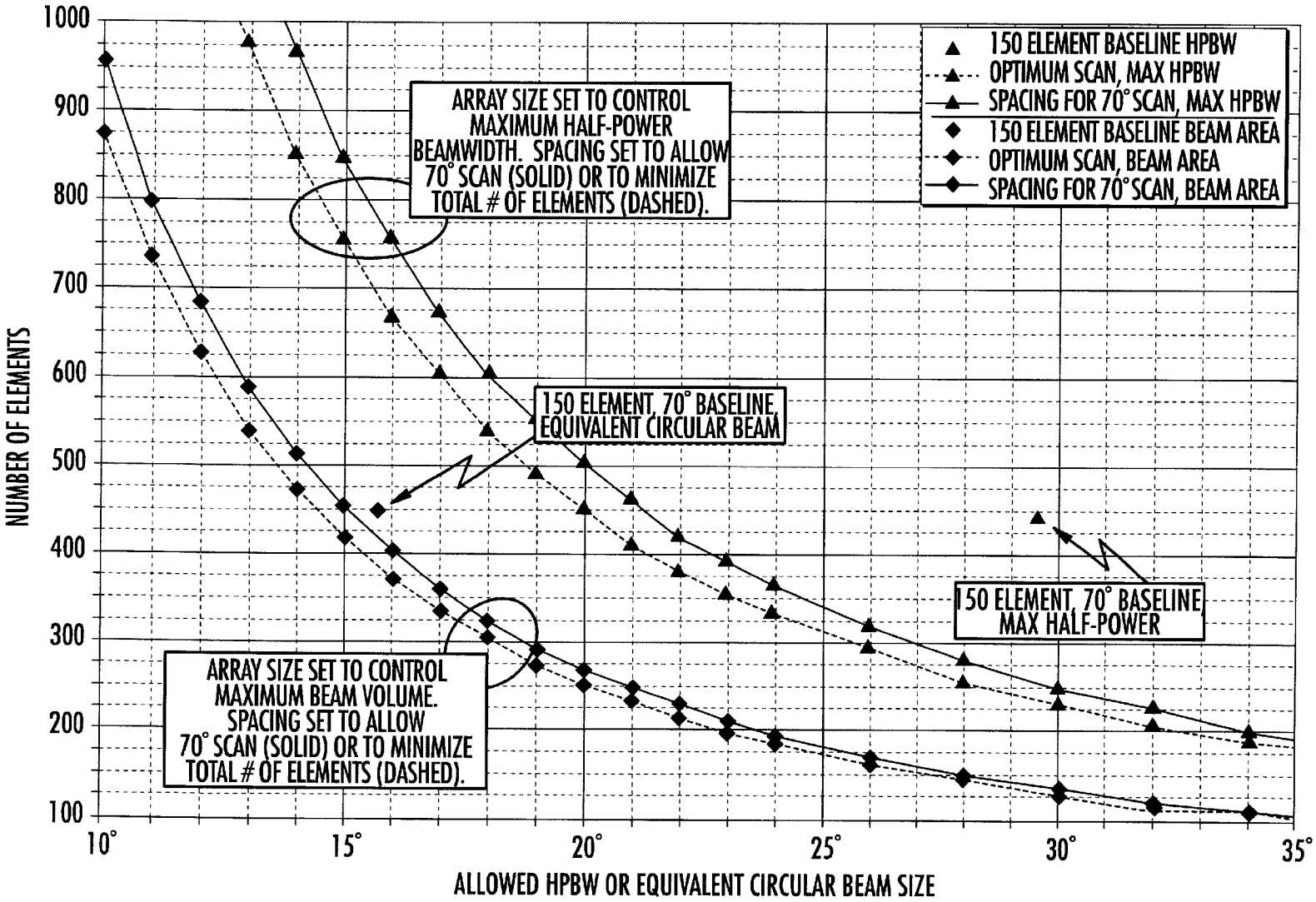
FIG. 10 is another graph similar to FIG. 9 showing the 150 element, 70 degree base line equivalent circular beam and the array size set to control maximum beam value.
Figure 11:
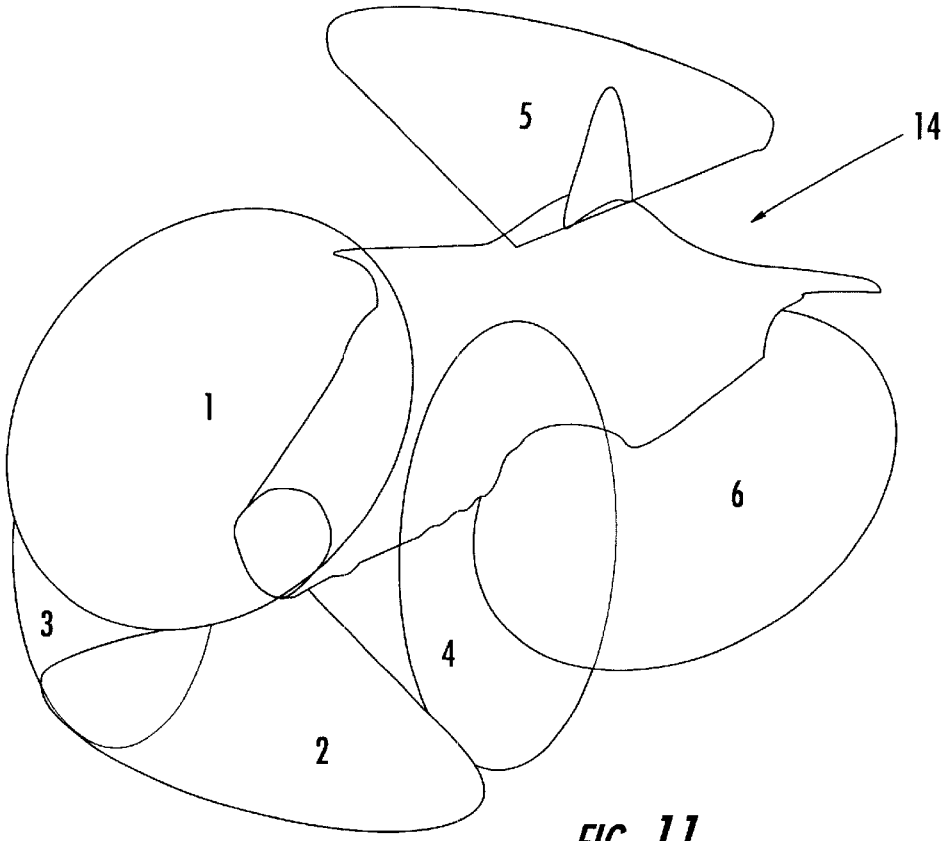
FIGS. 11 and 12 are respective front and rear views of an antenna placement and field of view on an aircraft with six phased array antenna structures having 48 elements each.

FIGS. 9 and 10 illustrate graphs showing the total element count required for spherical coverage with a constrained, scanned half-power beam width. A 150 element base line HPBW and optimum scan for the maximum HPBW and spacing for a 70 degree scan is shown in FIG. 9. FIG. 10 shows a 150 element, 70 degree base line equivalent circular beam and an array size set to control a maximum beam value.

Figure 12:
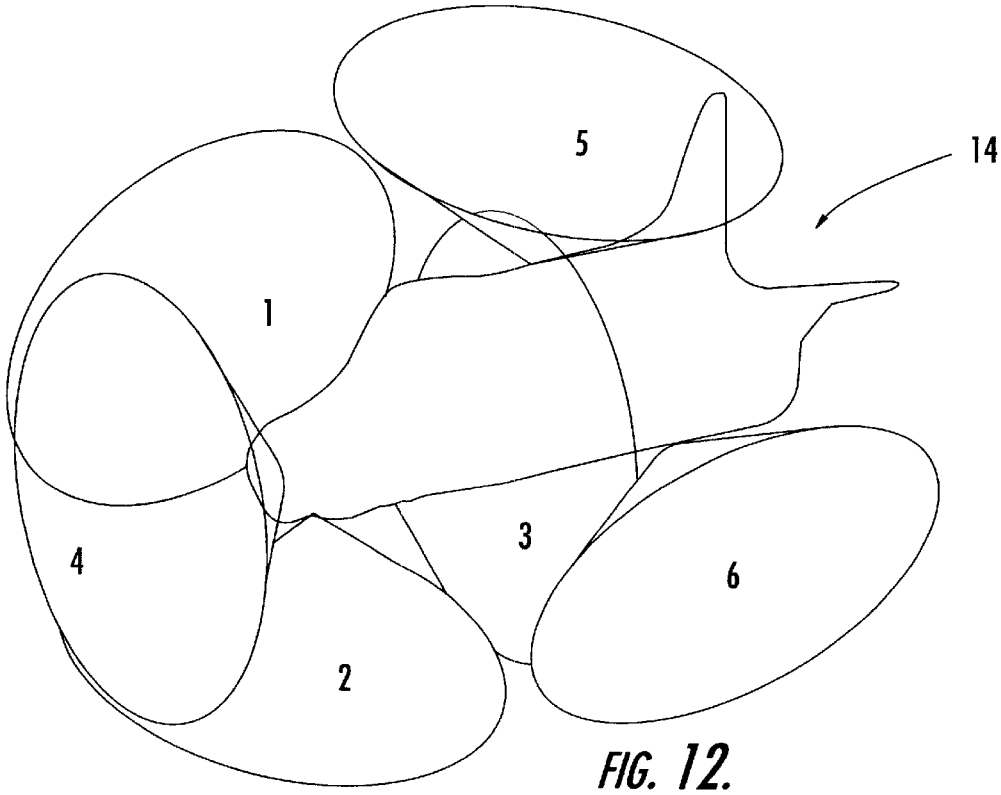
Figure 13:
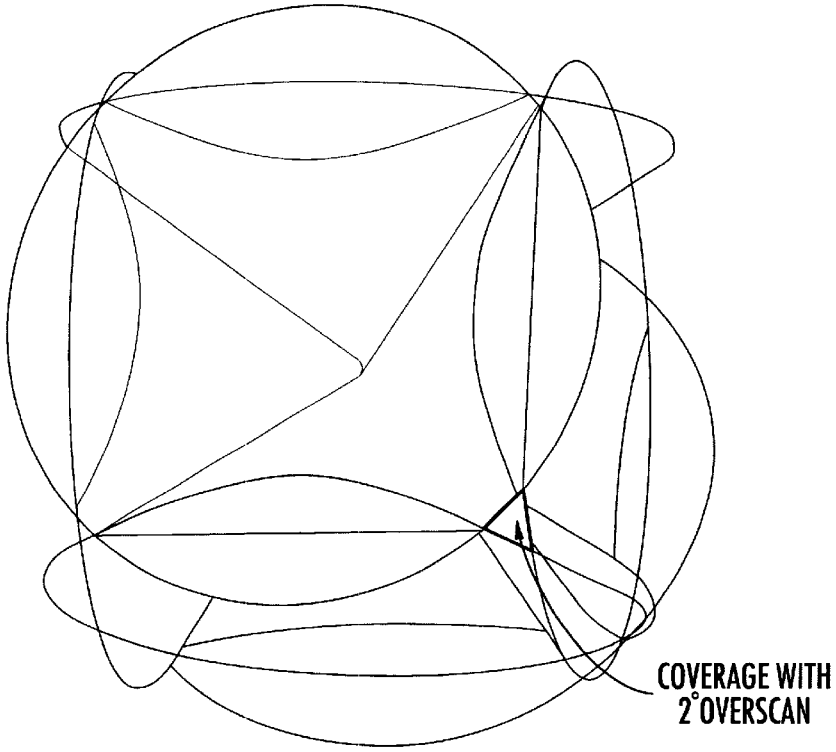
FIGS. 13 and 14 are respective front and rear views with volumetric coverage of the six phased array antenna structures of FIGS. 11 and 12 having +/−53.5 degree scan regions.
Figure 14:
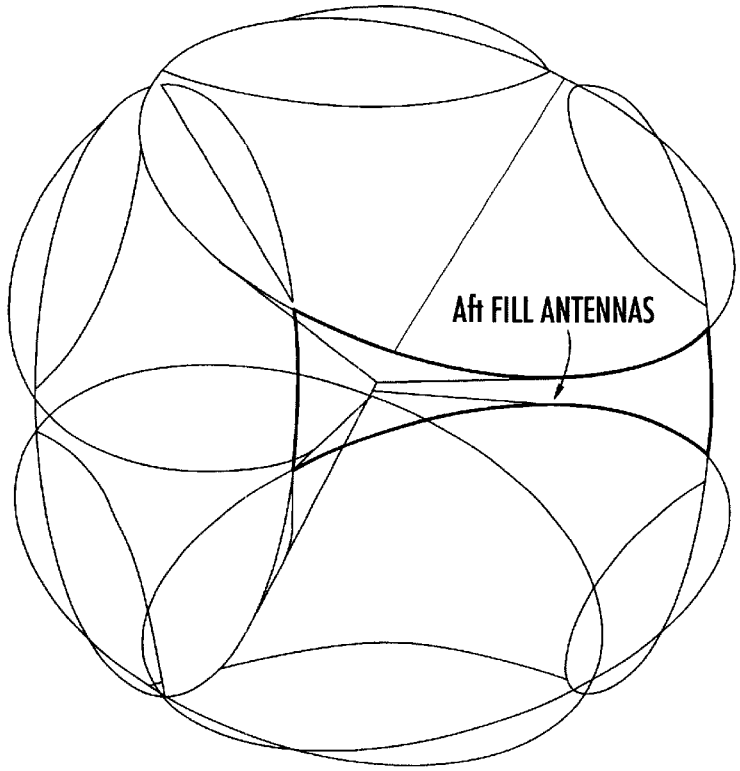

FIGS. 12–14 illustrate front and rear views for a phased array antenna structure of six arrays of 48 elements each.

Figure 15:
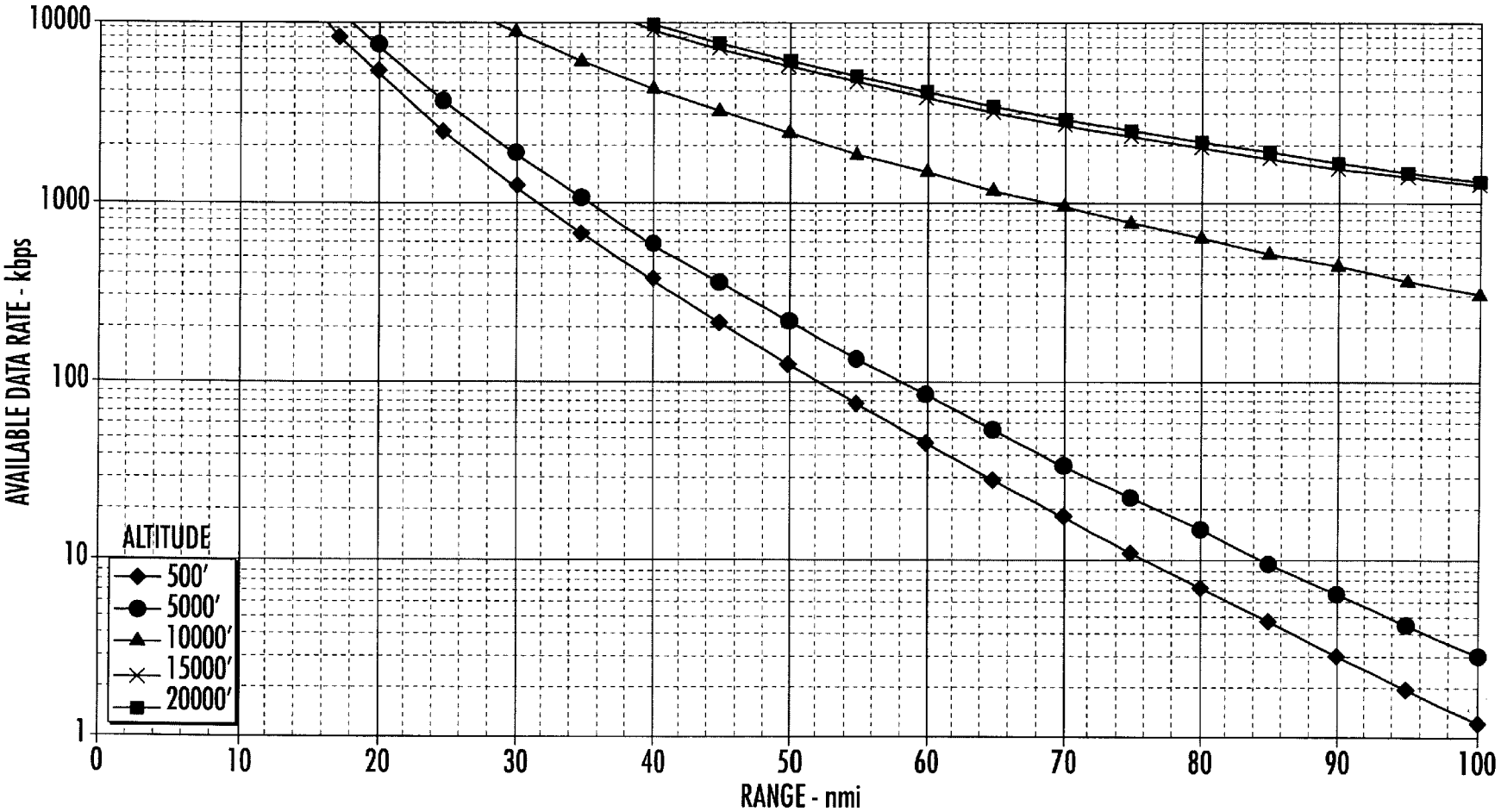
FIG. 15 is a graph showing the available data rate versus range for 90% availability with 48 elements at +/−53 degree scan.
Figure 16:
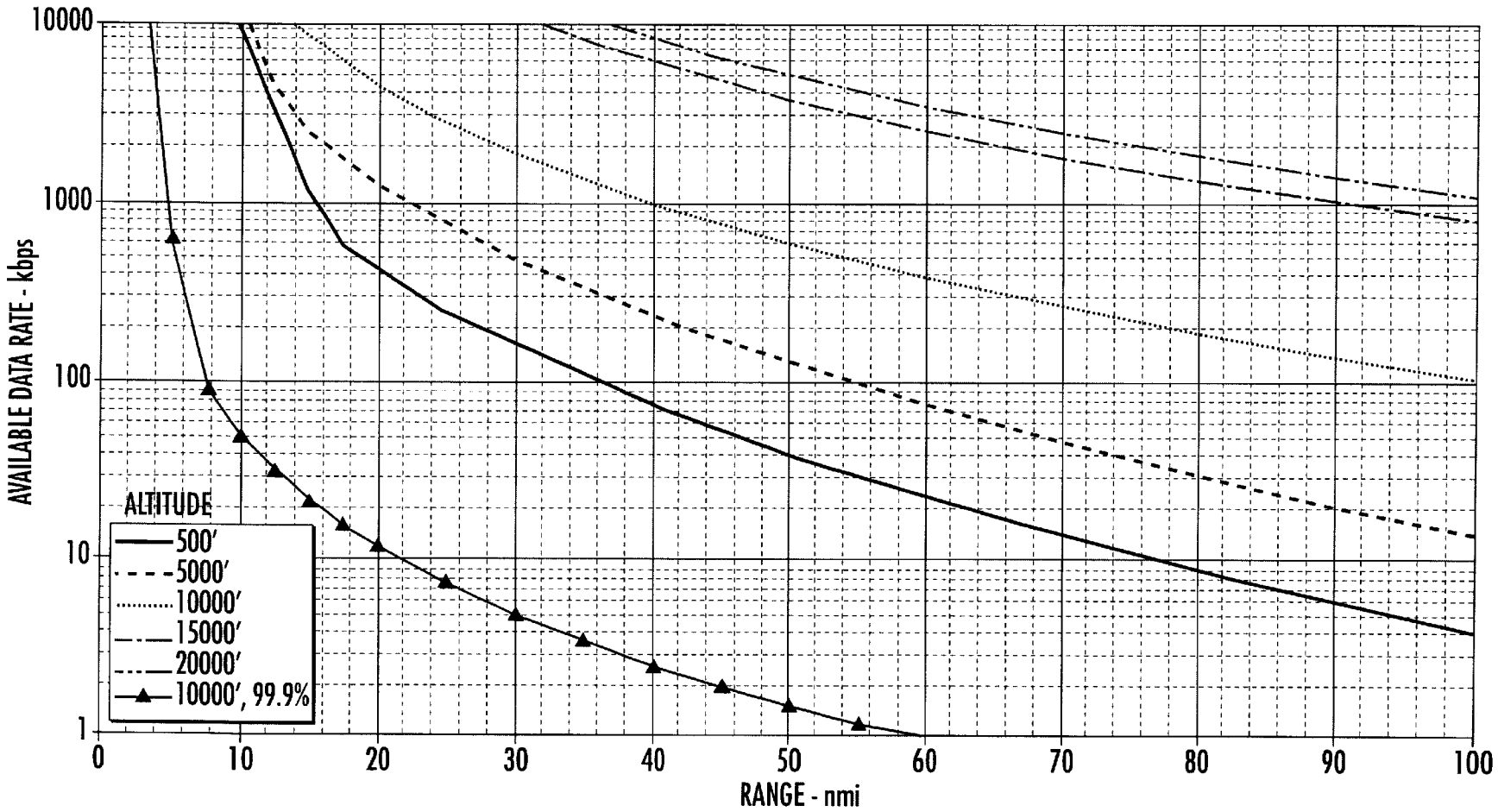
FIG. 16 is a graph similar to FIG. 15 but showing the available data rate versus range with 99% and 99.9% availability at 48 elements and +/−53 degree scan.

FIG. 15 is a graph illustrating the available data rate versus the range for a 90% availability at 48 elements with a +/−53 degree scan. FIG. 16 is another graph showing the available data rate versus range for a 99% and 99.9% availability with 48 elements and a +/−53 degree scan.

With six phased array antenna structures having 48 elements each and 288 total elements, it is possible to have a three inch diameter array aperture that could be roughly co-located with existing equipment on many aircraft. It is also possible that the antenna interface unit, power converter and controller could be shared for "clustered" arrays. Three aft antennas and antenna interface units could include aft, aft left and aft right. End-fire slot and small horn antenna are possible in some instances. Low noise amplifiers and power amplifiers and switch components can be optimally used.

Possible performance goals and a range of values that are optimal for the present invention include the following:

| CROSSLINK AND SATCOM RECEIVE SUBSYSTEM PERFORMANCE RANGES | |
|---|---|
| Type of Link | Air-Air and Air-Satellite |
| Range | 2 nmi to 100 nmi (Air-Air) |
| Altitude | 500'–40,000' |
| Field of Operations | Global |
| Field of View | 4 $\pi$ (to the extent possible) |
| Simultaneous Links | No Simultaneous Link Requirement |
| Link Availability | 90% |
| Data Rate | 64 kbps to 700 kbps |
| **OPERATIONAL DATA** | |
| Bit-Error-Rate | $10^{-6}$ |
| Coding | Rate ½, k = 7 Viterbi & (255, 238) R-S |
| Modulation | QPSK |
| $E_b/N_o$ Required | 5.5 dB |
| Link Margin | 1 dB |
| Randome Loss | 1 dB |
| Implementation Loss | 2.5 dB |
| Frequency | $K_a$ Band |
| Sidelobes | Trade Tx Sidelobe Reduction With Cost and Size |
| Size | Minimize Commensurate With Link Requirements |
| Interface | Consistent With Existing CNI System |
| Pointed Antenna System | (Tracking not required) |
| Data Rate | 64 kbps to 3 Mbps |
| Operational Altitude | From Above Precipitation (>20000') to Within Precipitation (500') |
| Link Availability - Rain Conditions (e.g., Miami, Florida) | 90%, 99%, 99.9% |
| Satellite EIRP - Drawing From MILSTAR and GBS Data | 58.0 dBW<br>53.2 dBW<br>52.8 dBW<br>49.2 dBW<br>44.8 dBW<br>40.7 dBW |
| **OTHER POSSIBLE DESIGN AND PERFORMANCE FACTORS** | |
| Antenna Type | Switched Horns<br>Mechanically Steered<br>Phased Array (active vs. passive, square vs. circular aperature)<br>Hybrid Configurations (combine mechanical, switched, or electronic steering) |
| Sidelobe Level: | Illumination Taper<br>−13.2 dB/−17.6 dB (Uniform Illumination), −20 dB, −25 dB, −30 dB and −35 dB SLL's |
| Maximum Scan Angle | ±30°, ±45°, ±60°, ±70°, |

It is evident that the present invention advantageously provides CNI system interface using one aircraft system to provide a phased array communication system for air-to-air crosslink communications, satellite receive communications and air-to-ground data link communications at a satellite downlink frequency band.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array communications system for an aircraft comprising:

a plurality of phased array antenna structures dispersed around an aircraft in a manner to provide substantially spherical antenna coverage around the aircraft each phased array antenna structure having an n-element array, transmit/receive modules operatively connected to respective elements forming said n-element array, a beam forming network operatively connected to said transmit/receive modules, and an antenna interface unit operatively connected to said beam forming network for converting communications signals between a satellite downlink frequency band and a communications band used by Communication, Navigation and Identification (CNI) components for allowing a) air-to-air crosslink communications; b) satellite receive communications; and c) air-to-ground data link communications at a satellite downlink frequency band; and a communications transceiver operatively connected to each antenna interface unit for receiving and transmitting communications signals within a communications band used by Communication, Navigation and Identification (CNI) components to and from said phased array antenna structures.

2. A phased array communications system according to claim 1, and further each comprising six phased array antenna structures each providing plus/minus about 48 to about 59 degree scan.

3. A phased array communications system according to claim 1, and further comprising three phased array antenna structures each providing plus/minus about 65 to about 75 degree scan.

4. A phased array communications system according to claim 1, wherein each phased array antenna structure further comprises a controller operatively connected to each transmit/receive module for controlling the beam of said phased array antenna.

5. A phased array communications system according to claim 4, wherein said controller is operative for selecting between communications waveforms and protocol functions for air-to-air crosslink, satellite receive and air-to-ground data link communications.

6. A phased array communications system according to claim 5, wherein a communications waveform and protocol function is selected based on the need of a supported aircraft weapon system.

7. A phased array communications system according to claim 1, wherein each phased array antenna structure further comprises a power converter for converting power from an on-board power source into power suitable for operation of said phased array antenna structure.

8. A phased array communications system according to claim 1, wherein each phased array antenna structure is operable within the Ka band for receiving satellite communications.

9. A phased array communication system according to claim 1, wherein said antenna interface unit is operable for converting S band communications signals into a satellite downlink frequency band.

10. A phased array communications system according to claim 1, wherein each phased array antenna structure is about three inches diameter, having about 45 to about 55 antenna elements.

11. A phased array communications system according to claim 1, wherein each transmit/receive module further comprises respective transmit and receive phase shifters and amplifiers.

12. A phased array antenna structure comprising:

an n-element array;

n number of transmit/receive modules operatively connected to respective elements forming said n-element array;

a beam forming network operatively connected to said transmit/receive modules; and an antenna interface unit operatively connected to said beam forming network, and comprising respective transmit and receive interface circuits and a controller including a synthesizer and control circuit operatively connected to the beam forming network and respective transmit and receive interface circuits for generating synthesizer and control signals to the beam forming network and transmit and receive interface circuits and converting communications signals between a satellite downlink frequency band and a communications band used by Communication, Navigation and Identification (CNI) components for allowing a) air-to-air crosslink communications; b) satellite receive communications; and c) air-to-ground data link communications at the satellite downlink frequency band.

13. A phased array antenna structure according to claim 12, wherein said beam forming network comprises an transmit beam forming network and a receive beam forming network.

14. A phased array antenna structure according to claim 13, wherein said transmit/receive modules each comprise respective transmit and receive phase shifters and amplifiers respectively connected to respective transmit and receive beam forming networks.

15. A phased array antenna structure according to claim 12, wherein said antenna interface unit comprises respective transmit and receive interface circuits for converting between the satellite downlink frequency band and the communications band used by Communication, Navigation and Identification (CNI) components.

16. A phased array antenna structure according to claim 12, wherein said n-element array provides plus/minus about 48 to about 59 degree scan.

17. A phased array antenna structure according to claim 12, wherein said n-element array provides plus/minus about 65 to about 75 degree scan.

18. A phased array antenna structure according to claim 12, wherein said controller is operatively connected to each transmit/receive module for controlling the beam of said phased array antenna.

19. A phased array antenna structure according to claim 18, wherein said controller is operative for selecting between communications waveforms and protocol functions for air-to-crosslink, satellite receive and air-to-ground data link communications.

20. A phased array antenna structure according to claim 19, wherein a communications waveform and protocol function is selected as based on the need of a supported aircraft weapon system.

21. A phased array antenna structure according to claim 12, wherein each phased array antenna structure further comprises a power converter for converting power from an on-board power source into power suitable for said phased array antenna structure.

22. A phased array antenna structure according to claim 12, wherein said phased array antenna structure is operable within the Ka band to received satellite communications.

23. A phased array antenna structure according to claim 12, wherein said antenna interface unit is operable for converting S band communications signals into a satellite downlink frequency band.

24. A phased array antenna structure according to claim 12, wherein said phased array antenna structure is about three inches diameter, having about 45 to about 55 antenna elements.

25. A phased array antenna structure according to claim 12, wherein each transmit/receive module further comprises respective transmit and receive phase shifters and amplifiers.

26. A method of communicating to and from an aircraft comprising the step of:

selecting communications waveforms and protocol for one of a) air-to-air crosslink communications; b) satellite receive communications; and c) air-to-ground data link communications at a satellite downlink frequency band using a plurality of phased array antenna structures dispersed around an aircraft in a manner to provide substantially spherical antenna coverage around the aircraft, each phased array antenna structure having an n-element array, n-transmit/receive modules operatively connected to respective elements forming said n-element array, a beam forming network operatively connected to said n-transmit/receive modules, and an antenna interface unit operatively connected to said beam forming network for converting communications signals between a satellite downlink frequency band and a communications band used by Communication, Navigation and Identification (CNI) components; and receiving and transmitting communications signals within the communications band used by Communication, Navigation and Identification (CNI) components to and from said phased array antenna structures using a communications transceiver operatively connected to each antenna interface unit of each phased array antenna structure.

* * * * *